US005832735A

United States Patent [19]

Matsumoto et al.

[11] Patent Number: 5,832,735

[45] Date of Patent: Nov. 10, 1998

[54] CONTROL SYSTEM FOR MULTIPLE-TYPE AIR CONDITIONER

[75] Inventors: Satoshi Matsumoto, Ota; Hikaru Katsuki, Kiryu, both of Japan

[73] Assignee: Sanyo Electric Co., Ltd., Osaka, Japan

[21] Appl. No.: 846,559

[22] Filed: Apr. 30, 1997

[30] Foreign Application Priority Data

Apr. 30, 1996 [JP] Japan ..... 8-132610

[51] Int. Cl.[6] ..... F24F 11/02

[52] U.S. Cl. ..... 62/151; 62/160; 62/175; 62/180

[58] Field of Search ..... 62/151, 156, 155, 62/160, 186, 140, 81, 234, 128, 180, 175

[56] References Cited

U.S. PATENT DOCUMENTS 3,777,505 12/1973 Otaki ..... 62/160 X
4,852,360 8/1989 Harshbarger, Jr. et al. ..... 62/156 X
5,046,323 9/1991 Kuwahara ..... 62/140

*Primary Examiner*—Harry B. Tanner
*Attorney, Agent, or Firm*—Darby & Darby

[57] ABSTRACT

An inexpensive control system for a multiple-type air conditioner makes it possible to automatically and independently detect frosting and conduct defrosting control in an outdoor unit during a reverse cycle heating operation in a two-compressor, multiple-type air conditioner which has an outdoor unit equipped only with a simple ON/OFF control function and which is not provided with a signal conductor for transmitting the information on the state of an outdoor unit to an indoor unit. In this case, the operation of the outdoor unit can be determined, monitored, and controlled from the indoor unit side so as to enable proper action to be taken. The control system is provided with means for independently controlling the operation of the outdoor unit and means for determining the operation of the outdoor unit from the indoor unit side according to the state of an indoor side heat exchanger and for controlling the operation of the air conditioner.

1 Claim, 4 Drawing Sheets

CONTROL SYSTEM FOR MULTIPLE-TYPE AIR CONDITIONER

BACKGROUND OF THE INVENTION

1. Field of the Invention

The present invention relates to a control system for a multiple-type air conditioner which constitutes a refrigerating cycle by a single outdoor unit equipped with compressors, four-way valves, and expansion devices respectively corresponding to a plurality of indoor units, and a common outdoor side heat exchanger; and a plurality of indoor units, each of which having an indoor side heat exchanger.

2. Description of Related Art

Hitherto, there has been known a two-compressor, separate-type air conditioner which is provided with a plurality of indoor units for a single outdoor unit. This type of air conditioner performs cooling and heating by switching the circulating direction of a refrigerant.

When the outdoor temperature goes down to about +5 degrees Celsius while the air conditioner is operating in a heating mode which is commonly known as a "reverse cycle heating" operation mode, the evaporating temperature of the refrigerant in an outdoor side heat exchanger becomes 0 degree Celsius or lower, causing "frosting" in which the moisture in the air turns into frost and adheres to the heat exchanger. If the frost is left unremoved, the frost builds up and eventually paralyzes the ventilation of the outdoor side heat exchanger. Furthermore, the thermal conductivity of the heat exchanger is deteriorated, thus disabling it from drawing outdoor heat.

The frosting problem is an inevitable problem with the reverse cycle heating operation of the air conditioner, and defrosting must be carried out to prevent the frosting problem.

As one of the defrosting methods in such a case, a reverse cycle defrosting method has been employed. According to the reverse cycle defrosting method, the refrigerating cycle is switched from a heating operation mode to a cooling operation mode during the heating operation so as to let a hot refrigerant gas, which is discharged from a compressor, flow into a frosted outdoor side heat exchanger, thereby melting the frost by the heat.

It takes a little time before the temperature is raised after the air conditioner starts the heating operation. When the air conditioner carries out the aforesaid defrosting control, it is placed in the cooling mode. Under such conditions, cold air would be blown into a room to cool the air in the room against the will of a user therein. To prevent such a situation, the air conditioner is provided with measures to prevent cold air from being let out.

There should be no substantial inconvenience in the case of a latest microprocessor-controlled air conditioner which allows the entire operation of the outdoor unit to be monitored and controlled from the indoor unit side. There is an inconvenience set forth below, however, in the case of a two-compressor, multiple-type air conditioner which has a simple outdoor unit that has no such means as a microcomputer and conducts merely ON/OFF control and which has no signal conductor for transmitting the information on the state of the outdoor unit to the indoor unit, the outdoor unit independently starting the defrosting operation. In such an air conditioner, there occurs a situation in which the indoor unit continues normal operation whereas the outdoor unit is carrying out the defrosting control, resulting in the inconvenience where the indoor unit blows cold air into the room while the outdoor unit is conducting the defrosting control.

SUMMARY OF THE INVENTION

Accordingly, it is an object of the present invention to provide an inexpensive control system for a two-compressor, multiple-type air conditioner which has an outdoor unit equipped only with a simple ON/OFF control function and which has no signal conductor for transmitting the information on the state of the outdoor unit to a latest microprocessor-controlled indoor unit, which control system enabling the outdoor unit to automatically and independently detect frosting and carry out defrosting control during a reverse cycle heating operation, and enabling the operation of the outdoor unit to be determined from the indoor unit side so as to take proper action as necessary and also the operation of the outdoor unit to be monitored and controlled from the indoor unit side just as in the case of a microprocessor-controlled air conditioner.

To this end, according to one aspect of the present invention, there is provided a control system for a multiple-type air conditioner, which control system is equipped with: means for independently controlling the operation of an outdoor unit; and means for making it possible to determine the operation of an outdoor unit from an indoor unit side according to the state of an indoor side heat exchanger to control the operation of the air conditioner; in a separate, multiple-type air conditioner which constitutes a refrigerating cycle by a common outdoor side heat exchanger, a single outdoor unit equipped with compressors, four-way valves, and expansion devices respectively corresponding to a plurality of indoor units, and a plurality of indoor units, each of which having an indoor side heat exchanger.

According to another aspect of the present invention, there is provided a control system for a multiple-type air conditioner in a separate, multiple-type air conditioner which constitutes a refrigerating cycle by a common outdoor side heat exchanger, a single outdoor unit equipped with compressors, four-way valves, and expansion devices respectively corresponding to a plurality of indoor units, and a plurality of indoor units, each of which having an indoor side heat exchanger. In the foregoing control system for the multiple-type air conditioner, an indoor unit is equipped with: means for preventing cool air blow which sends an ON or OFF signal for a compressor, an ON or OFF signal for an outdoor fan added to an outdoor side heat exchanger, a cooling or heating signal for switching a four-way valve to an outdoor unit and which decreases the air volume of an indoor fan added to an indoor side heat exchanger when the temperature of the indoor side heat exchanger has dropped down to a first preset value or lower while the heating signal is being issued to the outdoor unit and the ON signal for the compressor is being issued; and means for ending the cool air prevention to set the decreased air volume back to a preset air volume when the temperature of the indoor side heat exchanger has risen back to a temperature which is sufficient for heating operation.

According to the present invention, in a two-compressor, multiple-type air conditioner which is not provided with a signal conductor for transmitting the information on the state of an outdoor unit to an indoor unit, even if a latest microprocessor-controlled indoor unit is combined with an outdoor unit which has only a simple function for merely turning ON/OFF a motor that drives a compressor, the control can be carried out independently in the outdoor unit and the operation of the outdoor unit can be detected and determined from the indoor unit side so as to enable proper action to be taken.

Moreover, the detection of frosting and the defrosting control can be independently performed in the outdoor unit during the reverse cycle heating operation. In addition, even when the heating operation, or the detection of frosting and the defrosting control is carried out independently in the outdoor unit during the reverse cycle heating, such an operation performed in the outdoor unit can be detected and determined from the indoor unit side by a change in the temperature of the indoor side heat exchanger, thus permitting proper cold air blow prevention control to be conducted.

DESCRIPTION OF THE PREFERRED EMBODIMENTS

Figure 1:
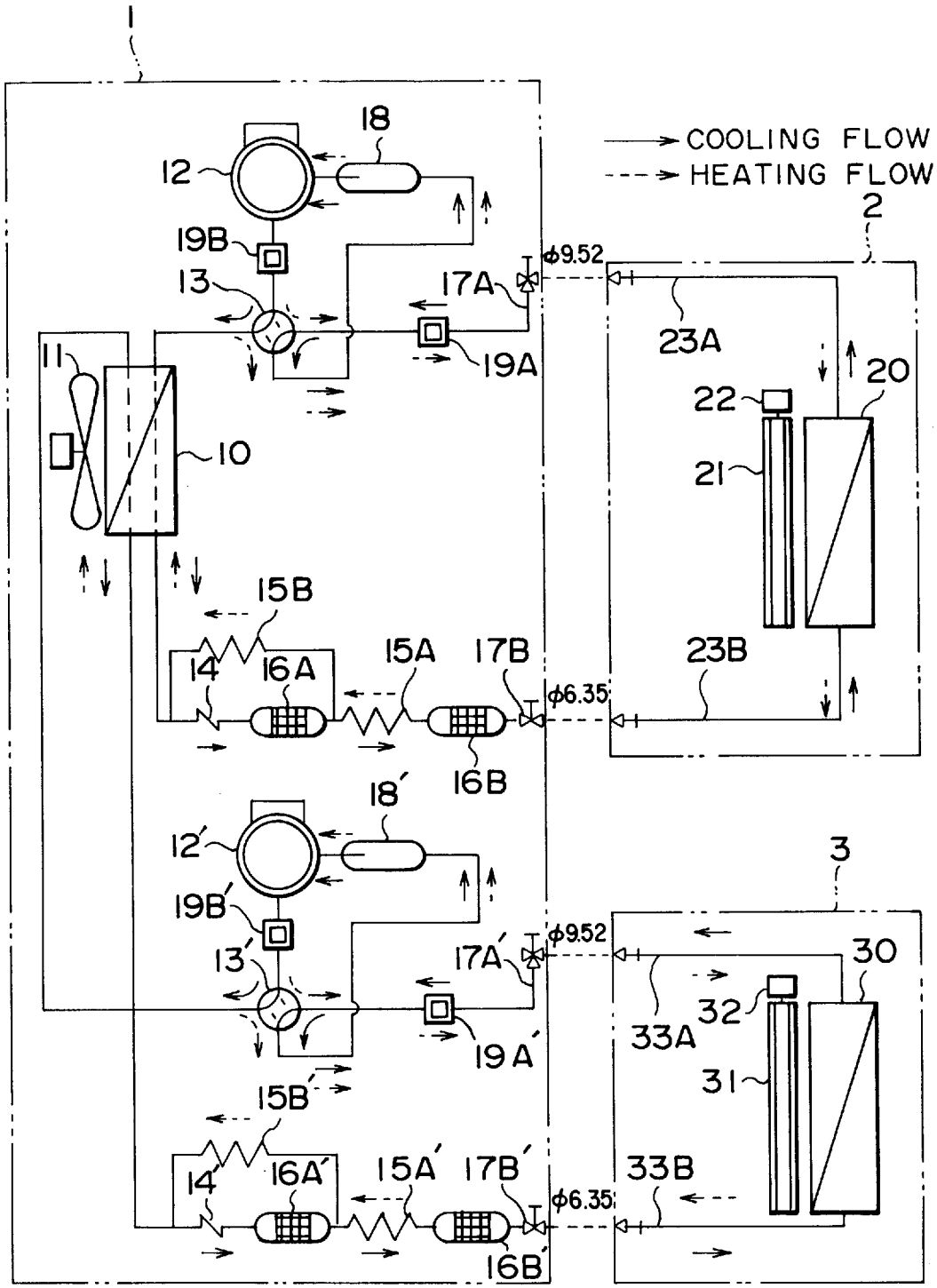
FIG. 1 is a block diagram showing a multiple-type air conditioner according to the present invention.

Referring to FIG. 1, the schematic configuration of a two-compressor , multiple-type air conditioner to which the present invention is applied will be described.

The multiple-type air conditioner is constructed by an outdoor unit 1 installed outdoors, and an indoor unit 2 and an indoor unit 3 installed indoors; these outdoor and indoor units are connected through refrigerant piping and signal conductors for transmitting commands from the indoor units.

Mounted on the outdoor unit 1 are a common outdoor side heat exchanger (a heat source side heat exchanger) 10, an outdoor fan 11 which is composed of a motor and a propeller fan to expedite the heat exchange between the outside air and the outdoor side heat exchanger 10, compressors 12 and 12', four-way valves 13 and 13' for switching the circulating direction of a refrigerant, check valves 14 and 14' for regulating the circulating direction of the refrigerant, capillary tubes (expansion devices) 15A and 15B, strainers 16A, 16'A, 16B and 16'B, refrigerant pipe connecting ports 17A, 17'A, 17B and 1 7'B, accumulators 18 and 18', mufflers 19A, 19'A, 19B and 19'B, and an outdoor side controller which will be discussed later.

The outdoor unit 1 does not have such means as a microcomputer; it carries out simple ON/OFF operation control.

Mounted on the indoor unit 2 are an indoor side heat exchanger (user side heat exchanger) 20, an indoor fan 21 composed of a fan motor 22 and a cross flow fan which is driven by the fan motor and returns the air, which has been heated or cooled by the indoor side heat exchanger 20, back into a room , refrigerant pipe connecting ports 23A and 23B, and an indoor side controller which will be discussed later.

Mounted on the indoor unit 3 are an indoor side heat exchanger (user side heat exchanger) 30, an indoor fan 31 composed of a fan motor 32 and a cross flow fan which is driven by the fan motor and returns the air, which has been heated or cooled by the indoor side heat exchanger 30, back into a room , refrigerant pipe connecting ports 33A and 33B, and an indoor side controller which will be discussed later.

The outdoor unit 1, the indoor unit 2, and the indoor unit 3 provided with the component units described above constitute a two-system refrigerating cycle by connecting the port 17A with the port 23A and the port 17'A with the port 33A, respectively, by a refrigerant pipe having a diameter of 9.52 mm and by connecting the port 17B with the port 23B and the port 17'B with the port 33B by a refrigerant pipe having a diameter of 6.35 mm as illustrated in FIG. 1.

The cooling operation and the heating operation via the foregoing refrigerant circulating path will now be described in conjunction with the outdoor unit 1 and the indoor unit 2. The relationship between the outdoor unit 1 and the indoor unit 3 is the same, and the description thereof will be omitted.

When the four-way valve 13 is in the state shown in FIG. 1, the refrigerant discharged from the compressor 12 circulates in the direction indicated by solid-line arrows (cooling operation mode).

First, the high temperature, high pressure gaseous refrigerant discharged from the compressor 12 passes through the muffler 19B and the four-way valve 13 in order and reaches the outdoor side heat exchanger 10.

Then, the outdoor side fan 11 blows air into the outdoor side heat exchanger 10 to cool the refrigerant so as to condense and liquefy it in the outdoor side heat exchanger 10.

The refrigerant then passes through the check valve 14 and the strainer 16A before it reaches the capillary tube 15A. At this time, the refrigerant is squeezed by the capillary tube 15A, so that it has a low temperature and a high pressure.

Then, the refrigerant goes through the strainer 16B, the port 17B, and the port 23B before it is supplied to the indoor side heat exchanger 20.

The indoor side heat exchanger 20 extends the piping passage through which the refrigerant circulates; therefore, the pressure in the indoor side heat exchanger 20 becomes low, causing the high-pressure refrigerant to evaporate and gasify. The heat of vaporization at that time lowers the temperature of the indoor side heat exchanger 20 and the cross flow fan 21 blows air out, thus cooling a room (indoor) to be air-conditioned.

The evaporated refrigerant passes through the port 23A, the port 17A , the muffler 19A, and the four-way valve 13 and reaches the accumulator 18. The accumulator 18 separates the refrigerant which has not gasified in the indoor side heat exchanger 20, i.e. liquid refrigerant, from gasified refrigerant , i.e. gaseous refrigerant, and it supplies only the gaseous refrigerant to the compressor 12. The compressor 12 recompresses the gaseous refrigerant to circulate it through the refrigerating cycle.

Thus, in the cooling operation mode, the refrigerant discharged from the compressor 12 condenses in the outdoor side heat exchanger 10 and evaporates in the indoor side heat exchanger 20 to exhaust the heat from the air-conditioned room to the outside, thereby enabling the air-conditioned room to be cooled.

In the heating operation mode, the four-way valve 13 is switched as indicated by dotted-line arrows shown in FIG. 1, and the refrigerant discharged from the compressor 12 circulates in the direction indicated by the dashed-line arrows in FIG. 1.

First, the high-temperature, high-pressure gaseous refrigerant discharged from the compressor 12 goes through the muffler 19B, the four-way valve 13, the muffler 19A, the port 17A, and the port 23A in order and reaches the indoor side heat exchanger 20.

Then, the cross flow fan 21 blows air into the indoor side heat exchanger 20 to cool the indoor side heat exchanger 20 which has been heated by the temperature of the refrigerant, and the refrigerant circulating inside condenses and liquefies. In other words, the cross flow fan 21 blows the air to the indoor side heat exchanger 20, which has been heated, so as to heat the room (indoor) to be air-conditioned.

The liquefied refrigerant then goes through the port 23B, the port 17B and the strainer 16B to reach the capillary tube 15A and the capillary tube 15B . At this time, the refrigerant is squeezed by the capillary tube 1 5A; therefore, it has a low temperature and a high pressure. The check valve 14 prevents the refrigerant from circulating through the strainer 16A.

Then, the refrigerant is supplied to the outdoor side heat exchanger 1 0. The outdoor side heat exchanger 10 extends the piping passage through which the refrigerant circulates; therefore, the pressure in the outdoor side heat exchanger 10 becomes low, causing the high-pressure refrigerant to evaporate and gasify. At this time, the outdoor fan 11 blows air to expedite the evaporation of the refrigerant.

The evaporated refrigerant is guided to the accumulator 18 via the four-way valve 13. The accumulator 18 separates the refrigerant which has not gasified in the outdoor side heat exchanger 10, i.e. liquid refrigerant, from gasified refrigerant, i.e. gaseous refrigerant, and it supplies only the gaseous refrigerant to the compressor 12. The compressor 12 recompresses the gaseous refrigerant to circulate it through the refrigerating cycle.

Thus, in the heating operation mode, the refrigerant discharged from the compressor 12 condenses in the indoor side heat exchanger 20 and evaporates in the outdoor side heat exchanger 10 to release the outdoor heat into the air-conditioned room, thereby enabling the heating of the room to be air-conditioned.

In this case, the indoor cooling or heating temperature can be maintained at a desired set temperature by microcomputer control according to the detection output of a temperature sensor disposed near the indoor fan21.

In the two-compressor, multiple-type air conditioner, the outdoor side heat exchanger 10 is shared by the indoor units 2 and 3. For this reason, the indoor units 2 and 3 cannot be operated in different modes; in other words, there will be no situation wherein the indoor unit 2 is operating in the heating mode, while the indoor unit 3 is operating in the cooling mode.

The air conditioner is set so that priority is given to the heating operation, and hence, if one indoor unit is operating in the heating mode, while the other indoor unit is operating in the cooling mode, then priority is given to the heating mode, and the compressor in the cooling mode is held at rest. As a result, the indoor unit simply blows air.

Figure 2:
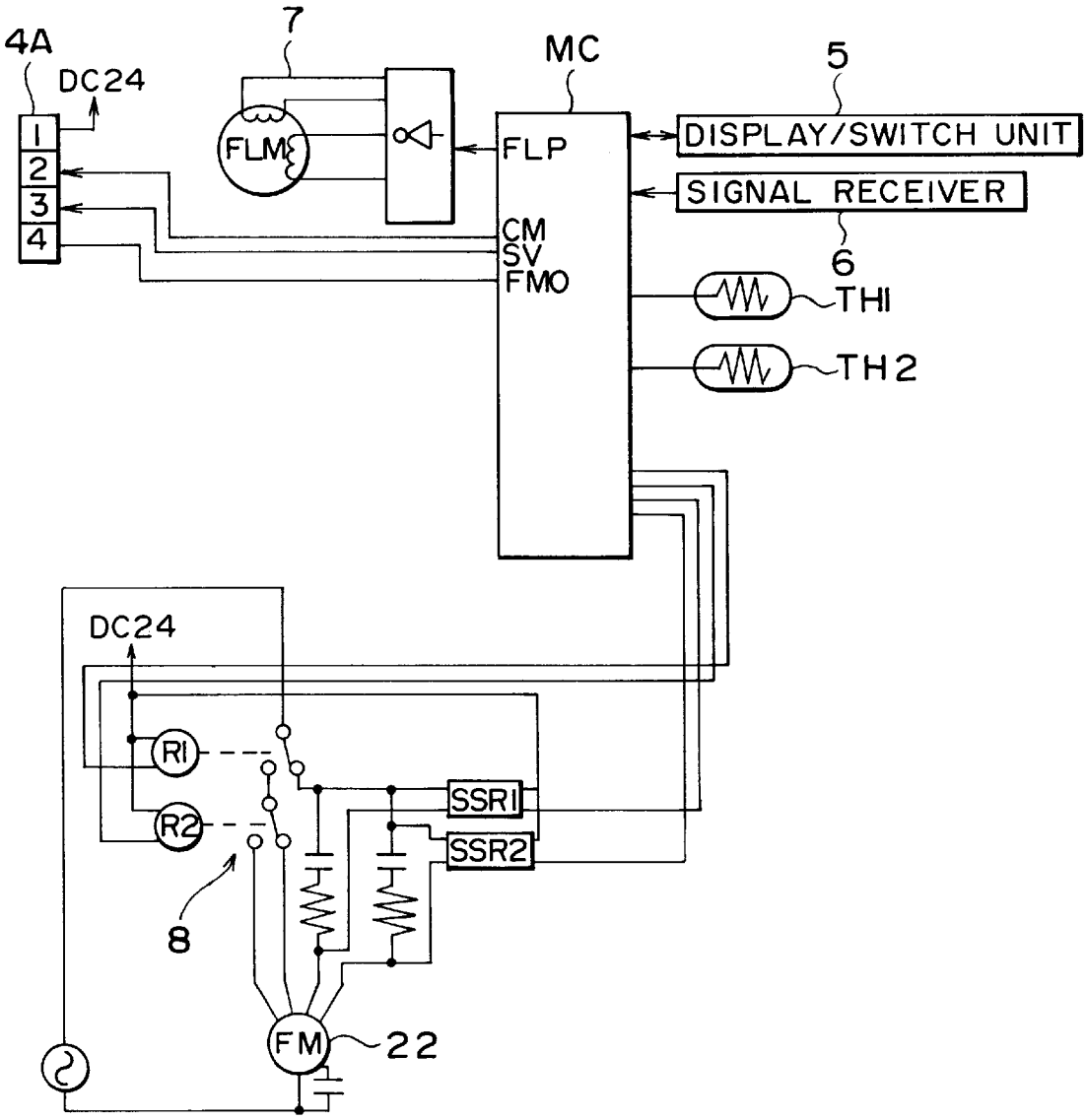
FIG. 2 is an electric circuit of a controller of an indoor unit.

FIG. 2 is an electric circuit diagram showing an essential section of the controller mounted on the indoor units 2 and 3. The following will describe the case wherein the controller is mounted on the indoor unit 2.

A microcomputer MC, e.g. TMS2600 made by INTEL, is provided with: switches for setting the basic mode of the air conditioner including a switch for selecting among power OFF, power ON, and test run, and a switch for displaying the brief history of a failure for a service staff, an operation display unit 5 for displaying the cooling operation mode, the heating operation mode, the cool air blow prevention, etc.; and a signal receiver 6 as a control interface which receives a wireless signal from a remote controller, demodulates it, and sends a control code to the microcomputer MC.

The remote controller is used primarily to: turn ON/OFF the air conditioner; switch among the heating mode, the cooling mode, and the fan mode; set the room temperature; set the air blow of the room fan 21 to high, medium, low, or automatic (H/M/L/auto); set the time on the timer to start or stop the operation; set the discharging direction of conditioned air, i.e. heated or cooled air, at a desired angle or for automatic setting; and detect the room temperature around the remote control and automatically send a value indicative of the room temperature to the signal receiver at predetermined intervals, e.g. 2 to 3 minutes.

The microcomputer MC controls the operation of the air conditioner according to the signals received from the remote controller. When the heating mode has been selected among the cooling mode, the heating mode, and the fan mode, the microcomputer MC issues to the controller of the outdoor unit 1 a signal (high-level voltage→low-level voltage) for turning ON the four-way valve 13 via a terminal No. 3 of a connector 4A; it judges the room temperature and the set temperature and supplies a signal (high-level voltage←→low-level voltage) for turning ON or OFF the compressor 12 to the controller of the outdoor unit 1 via a terminal No. 2 of the connector 4A.

Further, depending on whether the refrigerating cycle is in the high load condition, the microcomputer MC issues a signal (low-level voltage →←high-level voltage) for turning ON or OFF the outdoor fan 11 to the controller of the outdoor unit 1 via a terminal No. 4 of the connector 4A.

A stepping motor 7 changes the angle of an air blow shifting plate to change the vertical discharging direction of conditioned air. The speed of the stepping motor 7 is reduced through a combination of reduction gears. A range of about 90 degrees is divided into 512 steps, and the stepping motor 7 is run in the forward or reverse direction by a desired number of steps by the microcomputer MC via a driver so as to change the angle of the air blow changing plate as desired.

Hence, when the microcomputer MC switches the revolution of the stepping motor between the forward and reverse directions at a predetermined cycle, the discharging direction of conditioned air can be changed in succession, and therefore, this function is generally known as "swing."

A single-phase induction motor 22 drives the cross flow fan of the indoor fan 21; it is equipped with speed regulating terminals based on a selector circuit 8 for selection among high, medium, low, and very low (H/M/L/LL). The supply of current to these speed regulating terminals is controlled by the microcomputer MC through relays R1 and R2 which have selector armatures. The selection between low and very low (L and LL) is performed by the microcomputer MC through electronic switches SSR1 and SSR2.

The microcomputer MC controls the relays and the electronic switches according to the signals received from the remote controller. Further, when the air blow has been set for auto, the microcomputer automatically changes the air blow so that it increases as the room temperature goes away from a set temperature or it decreases as the room temperature comes closer to the set temperature. When the compressor 12 is at halt in the cooling operation mode or the heating operation mode, the air blow is set to low. During the defrosting operation, the cool air blow prevention is carried out wherein the air blow is set to very low or brought to a halt.

TH1 and TH2 denote temperature sensors; TH1 is a thermistor installed to detect the temperature of the indoor side heat exchanger 20 and TH 2 is a thermistor installed to detect the temperature of the room air sucked in by the room fan 21.

The temperature detected by the thermistor TH1 is used for detecting the frosting of the outdoor side heat exchanger in the heating operation mode and for starting the defrosting operation, preventing cool air blow in the heating operation mode, and preventing the freezing in the cooling operation mode.

The temperature detected by the thermistor TH2 is compared with the room temperature sent from the remote controller and if the room temperature reported by the remote controller is decided to be abnormal (e.g. the remote controller is exposed to direct sunlight or to the air discharged from the air conditioner) or if no periodic reports are received from the remote controller (e.g . the transmitting section of the remote controller is in a shade or the remote controller is in a drawer or the like), the temperature detected by the thermistor TH2 is adopted as the room temperature.

Figure 3:
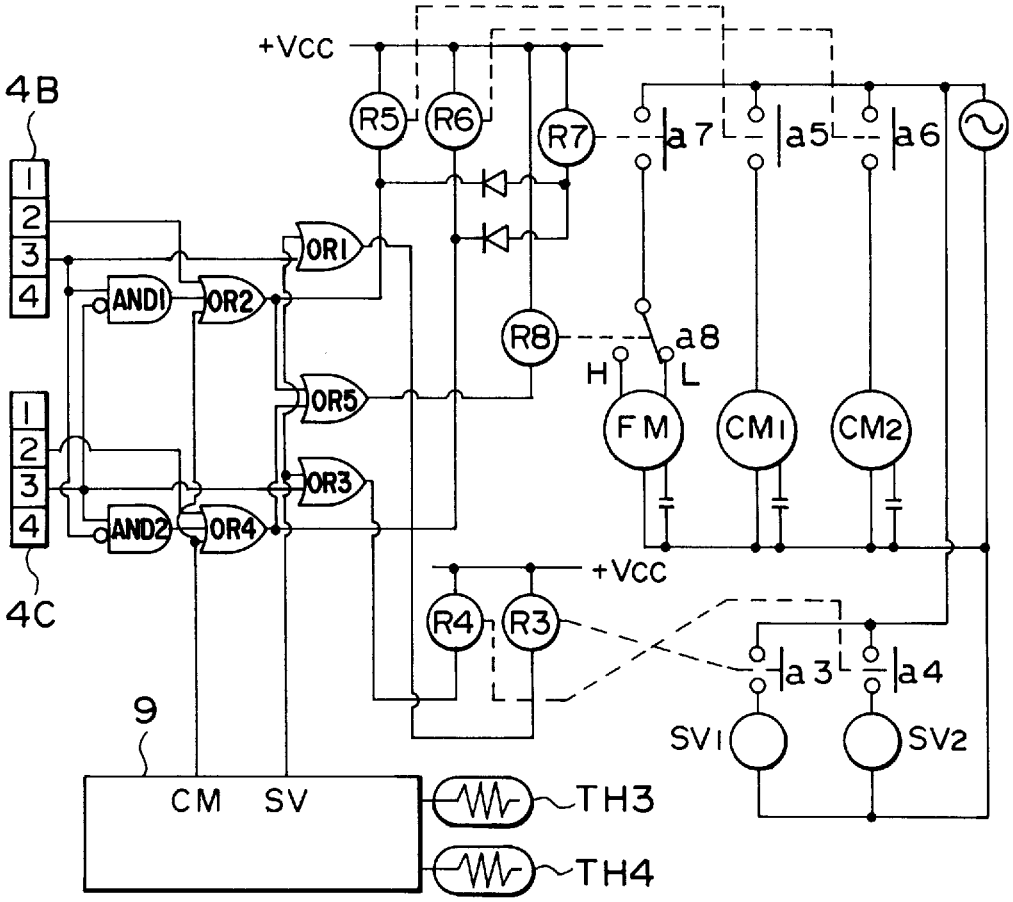
FIG. 3 is an electric circuit of a controller of an outdoor unit.

FIG. 3 is an electric circuit diagram illustrating an essential section of the controller of the outdoor unit 1. In the diagram, the terminals of connector 4B and 4C are connected to the corresponding terminals of the connector 4A, matching like terminal numbers, of the controller of the indoor unit 2 shown in FIG. 2.

An operating signal for the compressor 12 is applied to the terminal No. 2 of the connector 4B; the signal is at the low-level voltage, but it switches to the high-level voltage when the compressor stops. A switching signal for the four-way valve 13 is applied to the terminal No. 3; the signal is at the low-level voltage during the heating operation, or at the high-level voltage during the cooling operation. The operating signal for the fan applied to the terminal No. 4 is not used. The line voltage (+Vcc) is applied to the terminal No. 1.

A solenoid SV switches the state of the four-way valve; when it is energized, the state of the four-way valve 13 is switched from the one indicated by the solid line to the one indicated by the dashed line as shown in FIG. 1. Hence, the refrigerating cycle shown in FIG. 1 is set to the heating operation mode when the solenoid SV is energized, while it is set to the cooling operation mode when the solenoid SV is de-energized.

When the terminal No. 3 of the connector 4B is switched to the low-level voltage, a normally open armature a3 of an auxiliary relay R3 is closed, causing a solenoid SV1 to be energized through the normally open armature a3; providing an OR gate OR1 in this signal path holds the solenoid at the high-level voltage to maintain the cooling operation at all times regardless of the signal voltage level at the terminal No. 3 as long as the output from a defrosting controller 9, which will be described later, stays at the high-voltage level.

When the terminal No. 2 of the connector 4B is switched to the low-level voltage, a normally open armature a5 of an auxiliary relay RS is closed and a motor CM1 of the compressor 12 is energized through the normally open armature aS; providing an OR gate OR2 and an AND gate AND1 in this signal path corrects the operating signal for the motor CM1 of the compressor 12.

The signals from the terminal No. 2, the AND gate AND1, and the defrosting controller 9, respectively, are applied to the OR gate OR2. The motor CM1 of the compressor 12 is held at a halt regardless of the signal at the terminal No. 2 while the high-level voltage signal is being received from at least the AND gate AND1 or the defrosting controller 9.

The output of the AND gate AND1 is at the high-level voltage when the terminal No. 3 of the connector 4B is at the high-level voltage, while the terminal No. 3 of the connector 4C is at the low-level voltage. Hence, the motor CM1 of the compressor 12 is not operated when one indoor unit is operating the cooling mode, while the other indoor unit is operating in the heating mode.

The supply of current to a fan motor FM is controlled via a normally open armature a7 of an auxiliary relay R7 and a selector armature a8 of an auxiliary relay R8. The auxiliary relay R7 is energized when at least the auxiliary relay R5 or R6 is energized, whereas the auxiliary relay R8 is energized when both auxiliary relays R5 and R6 are energized at the same time.

Accordingly, the fan motor FM is operated at low speed when at least one of the two compressors 12 and 12' is operating, whereas it is operated at high speed when both compressors 12 and 12' are operating.

The same configuration described above applies to the gate circuit connected to the connector 4C; therefore, the description thereof will be omitted . In the outdoor unit 1 thus configured, when both terminals CM and SV of the defrosting controller 9 are at the low-level voltage, the solenoids SV1 and SV2 of the four-way valves 13 and 13', respectively, are controlled by the outputs from the terminals No. 3 of the respective connectors 4B and 4C. Thus, the cooling operation mode and the heating operation are set.

If the outputs of both terminals No. 3 of the connectors 4B and 4C are the same, that is, if they are both set for the cooling operation mode or the heating operation mode, then the respective AND gates AND1 and AND2 issue low-level voltage outputs; therefore, the compressors 12 and 12' are turned ON or OFF in response to the outputs received from the respective indoor units 2 and 3 according to the outputs from the terminals No. 2 of the connectors 4B and 4C.

If the terminal No. 3 of the connector 4B is at the low-level voltage, while the terminal No. 3 of the connector 4C is at the high-level voltage, that is, if the indoor unit 2 is in the heating operation mode, while the indoor unit 3 is in the cooling operation mode, then the AND gate AND2 of the indoor unit in the cooling operation mode issues the high-level voltage; therefore, the OR gate OR4 holds the motor CM1 of the compressor 12. As a result, the heating operation mode is given priority and the indoor unit 3 in the cooling operation mode merely blows air.

Continued heating operation when the outside temperature is low causes the outdoor side heat exchanger 10 to be frosted. The defrosting controller 9 has the temperature sensor TH1 for detecting the temperature of the outside air and the temperature sensor TH2 for detecting the temperature of the outdoor side heat exchanger 10 so as to detect the frosting of the outdoor side heat exchanger 10 and judge the end of the defrosting operation.

Firstly, the defrosting controller 9 determines that the outdoor side heat exchanger 10 has been frosted when the temperature of the outside air is a predetermined level or lower, e.g. about +5 degrees Celsius at which frosting is judged to occur, and when the gradient of the temperature drop of the outdoor side heat exchanger 10 is a predetermined value or more, the predetermined value being established according to the operating capacity of the compressor or the capacity of the outdoor side heat exchanger, that is, when the defrosting controller 9 decides that the outdoor side heat exchanger 10 is no longer sufficiently functioning as the evaporator. As a simpler alternative, the defrosting controller 9 may start the defrosting operation when the temperature of the outdoor side heat exchanger 10 has dropped down to −9 degrees Celsius or lower and terminates the defrosting operation when it has risen back to +12 degrees Celsius or higher.

Figure 4:
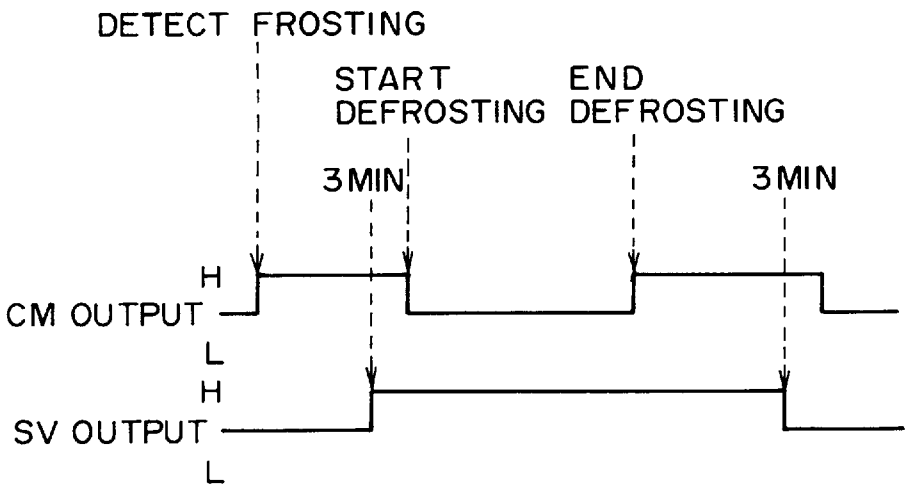
FIG. 4 is a timing chart illustrating the detection of frosting and a defrosting operation.

Referring now to FIG. 4, the timing for the detection of frosting and the timing for the defrosting operation will be described.

When the frosting is detected from the temperatures detected by temperature sensors TH3 and TH4, the voltage at the terminal CM of the defrosting controller 9 is first switched to the high level to stop the motors CM1 and CM2 of the compressors 12 and 12', and the fan motor FM.

Then, after a predetermined period of time, about three minutes, elapses until the high and low pressures in the respective refrigerating cycles are balanced, the terminal SV is switched to the high-level voltage to set the two four-way valves 13 and 13' for the cooling operation mode (the reverse cycle defrosting is performed in this embodiment). In a few seconds, the terminal CM is switched to the low-level voltage to restart the operation of the motors of the compressors and the fan motor FM (the compressor with the terminal No. 2 at the low-level voltage is restarted).

This causes the outdoor side heat exchanger 10 to work as the condenser, and the outdoor side heat exchanger 10 is defrosted using the heat of condensation of the refrigerant discharged from the compressors 12 and 12'. The defrosting operation is terminated when the temperature of the outdoor side heat exchanger 10 reaches the predetermined temperature, e.g. about +12 degrees Celsius, or above. When it is determined that the defrosting operation has been terminated, the terminal CM of the defrosting controller 9 is switched to the high-level voltage to stop the compressors.

After the elapse of the predetermined period of time required for the high and low pressures in the refrigerating cycles to be balanced as described above, the output of the terminal SV of the defrosting controller 9 switches to the low-level voltage to reset the states of the four-way valves 13 and 13'. In a few more seconds, the terminal CM is switched back to the low-level voltage to render the outputs of the respective terminals No. 2 effective.

In the indoor units 2 and 3, as the compressors 12 and 12' are operated, the temperatures of the indoor side heat exchangers 20 and 30 rise to enable the heating operation, however, for a while after the heating operation is initiated, the temperatures are not high enough, so that cold air is blown out of the indoor fans 21 and 31 against a user request for heating.

To prevent such an undesirable situation, the heating operation start signal which turns the compressor ON is used as the signal for starting the cold air blow prevention. This signal causes the microcomputers MC of the indoor units 2 and 3 to start the operation for preventing the cold air blow and accordingly, the indoor fans 21 and 31 are forcibly set to "very low" or brought to a halt to prevent cold air from being let out. This prevention of cold air blow is continued until the indoor side heat exchangers 20 and 30 reach a predetermined temperature, about +35 degrees Celsius which is sufficiently high for the heating operation. Once the predetermined temperature, about +3 5 degrees Celsius, is reached, the operation for preventing the cold air blow is terminated, and the indoor fans are set back to a preset air blow.

As was stated previously, when the outdoor side heat exchanger 10 is frosted, the efficiency of the heat exchange between the outdoor side heat exchanger 10 and the outside air is decreased, causing the temperatures of the indoor side heat exchangers 20 and 30 to decrease. When the defrosting control is initiated by the defrosting controller 9 of the outdoor unit 1 as mentioned above, the cooling operation mode is engaged and temperatures of the indoor side heat exchangers 20 and 30 are decreased.

When the microcomputer MC of the indoor unit 2 detects, from the change in the temperatures, that the temperatures of the indoor side heat exchangers 20 and 30 have dropped down to a first preset value, −10 degrees Celsius, or below, it judges that the outdoor unit 1 has begun the defrosting control. The indoor units 2 and 3 start the prevention of cold air blow, stop the indoor fans 21 and 31, and display to that effect.

When the heating operation is resumed after the completion of the defrosting operation, the microcomputer MC sets the indoor fans 21 and 31 to "very slow" or keep them at a halt for a while, then it clears the cold air blow prevention mode and sets the indoor fans back to the present air blow as soon as the temperatures of the indoor side heat exchangers 20 and 30 reach the foregoing predetermined temperature, about +35 degrees Celsius.

Thus, according to the present invention, in a two-compressor, multiple-type air conditioner which is not provided with a signal conductor for transmitting the information on the state of an outdoor unit to an indoor unit, even if a latest microprocessor-controlled indoor unit is combined with an outdoor unit which has only a simple function for merely turning ON/OFF a motor that drives a compressor, the control can be carried out independently in the outdoor unit and the operation of the outdoor unit can be detected and determined from the indoor unit side so as to enable proper action to be taken.

Moreover, the detection of frosting and the defrosting control can be independently performed in the outdoor unit during the reverse cycle heating operation. In addition, even when the heating operation, or the detection of frosting and the defrosting control is carried out independently in the outdoor unit during the reverse cycle heating, such an operation performed in the outdoor unit can be detected and determined from the indoor unit side by a change in the temperature of the indoor side heat exchanger, thus permitting proper cold air blow prevention control to be conducted.

What is claimed is:

1. Multiple-type air conditioner which constitutes a refrigerating cycle by a common outdoor side heat exchanger, an outdoor unit equipped with at least one each of a compressor, four-way valve, and expansion device respectively corresponding to a plurality of indoor units, said plurality of indoor unit having an indoor side heat exchanger, and a control system for said multiple-type air conditioner which comprises:

a controller for independently controlling the defrost operation of said outdoor unit, said controller is provided in said outdoor unit, and an indoor side controller for outputting an ON or OFF signal for a compressor, an ON or OFF signal for an outdoor fan arranged to an outdoor side heat exchanger, and a cooling operation/heating operation signal for switching a four-way valve, decreasing the air volume of an indoor fan arranged to said indoor side heat exchanger when a temperature of said indoor side heat exchanger has dropped down to a first preset value or lower while the heating operation signal is being issued to said outdoor unit and the ON signal for said compressor is being issued, and ending the prevention of cool air blow to set the decreased air volume back to a preset air volume when said temperature of said indoor side heat exchanger has risen back to a temperature which is sufficient for heating operation.

* * * * *